US012281538B2

(12) United States Patent
Polo Terán et al.

(10) Patent No.: US 12,281,538 B2
(45) Date of Patent: Apr. 22, 2025

(54) METHODS AND SYSTEMS FOR CEMENTED OPEN HOLE INTELLIGENT COMPLETIONS IN MULTILATERAL WELLS REQUIRING FULL ISOLATION OF GAS CAP, FRACTURES AND / OR WATER BEARING BOUNDARIES

(71) Applicant: Saudi Arabian Oil Company, Dhahran (SA)

(72) Inventors: Juan Manuel Polo Terán, Dhahran (SA); Abdullah Rashed Ibrahim Al-Dossary, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 172 days.

(21) Appl. No.: 17/654,132

(22) Filed: Mar. 9, 2022

(65) Prior Publication Data

US 2023/0287759 A1 Sep. 14, 2023

(51) Int. Cl.
*E21B 33/14* (2006.01)
*E21B 17/02* (2006.01)
(Continued)

(52) U.S. Cl.
CPC ..... *E21B 33/14* (2013.01); *E21B 17/028* (2013.01); *E21B 23/06* (2013.01); *E21B 34/06* (2013.01); *E21B 41/0035* (2013.01)

(58) Field of Classification Search
CPC ..... E21B 41/0035; E21B 33/14; E21B 33/13; E21B 17/028; E21B 23/06; E21B 34/06;
(Continued)

(56) References Cited

U.S. PATENT DOCUMENTS 5,526,880 A 6/1996 Jordan, Jr. et al.
6,230,807 B1 5/2001 Patel
(Continued)

FOREIGN PATENT DOCUMENTS

GB 2472575 A * 2/2011 ..... E21B 47/102
WO 2021158519 A1 8/2021

OTHER PUBLICATIONS

Lukoil: First Intelligent Multilateral TAML5 Wells on the V. Filanovsky Field; https://www.rogtecmagazine.com/lukoil-first-intelligent-multilateral-taml5-wells-v-filanovsky-field/ Dec. 13, 2017.
(Continued)

*Primary Examiner* — George S Gray
(74) *Attorney, Agent, or Firm* — Leason Ellis LLP

(57) ABSTRACT

A method of providing a cemented open hole intelligent completion in a well containing an open hole having a perimeter in which plurality of laterals are embedded. The method comprises deploying a first string section in a portion of the open hole containing the plurality of laterals, the first section having intelligent completion components including control valves, gauges and control lines operable from a surface station, deploying a second string section coupled to and positioned above the first string section and above the plurality of laterals including a setting packer, and delivering cement downhole that sets in a cemented section comprising an annulus between the second string and the perimeter of the open hole. The cemented section is positioned above the plurality of laterals so as to block fluids from production while not interfering with communication between the surface and the intelligent components of the first string.

17 Claims, 9 Drawing Sheets

(51) Int. Cl.

| | |
|---|---|
| ***E21B 23/06*** | (2006.01) |
| ***E21B 34/06*** | (2006.01) |
| ***E21B 41/00*** | (2006.01) |

(58) Field of Classification Search
CPC ..... E21B 43/08; E21B 43/10; E21B 43/12; E21B 43/14
See application file for complete search history.

(56) References Cited

U.S. PATENT DOCUMENTS

| | | | |
|---|---|---|---|
| 7,866,414 | B2 | 1/2011 | Patel |
| 9,062,530 | B2 | 6/2015 | Patel et al. |
| 9,777,554 | B2 | 10/2017 | Tunget |
| 10,344,570 | B2 | 7/2019 | Steele |
| 10,487,629 | B2 | 11/2019 | Saldanha et al. |
| 10,557,331 | B2 | 2/2020 | Rodriguez et al. |
| 10,557,341 | B2 | 2/2020 | Kolchanov et al. |
| 10,718,181 | B2 | 7/2020 | Saldanha et al. |
| 10,961,824 | B2 | 3/2021 | Steele et al. |
| 11,078,751 | B2 | 8/2021 | Arsalan et al. |
| 2010/0319928 | A1* | 12/2010 | Bussear ..... E21B 34/06 166/387 |
| 2011/0011580 | A1* | 1/2011 | Clark ..... E21B 33/124 166/66.5 |
| 2021/0332662 | A1 | 10/2021 | Gissler et al. |
| 2021/0355790 | A1 | 11/2021 | Fripp et al. |
| 2021/0355803 | A1 | 11/2021 | Cho et al. |

OTHER PUBLICATIONS

Offshore Magazine; Intelligent multilateral wells maximize reservoir contact; https://www.offshore-mag.com/home/article/16754318/intelligent-multilateral-wells-maximize-reservoir-contact; Nov. 30, 2006.

* cited by examiner

METHODS AND SYSTEMS FOR CEMENTED OPEN HOLE INTELLIGENT COMPLETIONS IN MULTILATERAL WELLS REQUIRING FULL ISOLATION OF GAS CAP, FRACTURES AND / OR WATER BEARING BOUNDARIES

FIELD OF THE DISCLOSURE

The present disclosure relates to oil and natural gas drilling and production. More particularly, the present disclosure relates to methods and systems for cemented open hole intelligent completions in multilateral wells that require full isolation of gas caps, fractures and/or water-bearing boundaries.

BACKGROUND OF THE DISCLOSURE

After a well is drilled to access a target reservoir, a completion process is performed to prepare the well for production operations. Casings or liners are normally deployed and cemented before completion operation. A completion string that includes a plurality of hydraulically or electrically actuated valves and corresponding sensors can then be lowered into and positioned within the casing or open hole. In so-called "intelligent" completions, the sensors collect reservoir information and monitor the well in real time, and the hydraulically or electrically actuated valves can be activated based on the measured downhole fluid parameters. Completion deployment gets more complex as more lateral boreholes ("laterals") are drilled from the main wellbore.

As of today, intelligent completions have set their own mark in extended reach multilateral wells in which they are deployed in new or re-entry wells. However, most of the intelligent completions deployed thus far are in cased holes and follow a structured design pattern. Few intelligent completions have been deployed directly across the open hole to accomplish isolation or compartmentalization between laterals. Existing off-bottom cemented liner technology does not enable the installation of intelligent completions below the cemented liner since the intelligent completions require connectivity between the surface command station and the hydraulic and electric cables during operation and production. Furthermore, current intelligent completion techniques do not permit the completion in this region of the borehole to be cemented.

SUMMARY OF THE DISCLOSURE

In a first aspect, the present disclosure describes a method of providing a cemented open hole intelligent completion in a well containing an open hole having a perimeter in which plurality of laterals are embedded. The method comprises deploying a first string section in a portion of the open hole containing the plurality of laterals, the first section having intelligent completion components including inflow control valves, temperature and pressure gauges and control lines operable from a surface station, deploying a second string section coupled to and positioned above the first string section and above all of the plurality of laterals, the second string section including a liner assembly with cement kit and a setting packer. Cement is delivered downhole and the cement sets in a cemented section comprising an annulus between the second string and the perimeter of the open hole which is seated on the setting packer expanded to the perimeter of the open hole. The cemented section is positioned above all of the plurality of laterals so as to block fluids that emanate from the laterals from production while not interfering with communication between the surface and the intelligent components of the first string.

In a second aspect, the present disclosure provides a cemented open hole intelligent completion system for a well containing an open hole having a perimeter in which plurality of laterals are embedded. The system comprises a first string section positioned in a portion of the open hole containing the plurality of laterals, the first string having intelligent completion components including inflow control valves, temperature pressure gauges and control lines operable from a surface station, feed through open hole swellable and/or feed through open hole mechanical packer, a second string section coupled to and positioned above the first string section and above all of the plurality of laterals, the second string section including a liner hanger assembly with cement kit and a setting packer expanded to the perimeter of the open hole. A cemented section comprises an annulus between the second string and the perimeter of the open hole. The cemented section is positioned above all of the plurality of laterals so as to block fluids that emanate from the laterals from production while not interfering with communication between the surface and the intelligent components of the first string.

These and other aspects, features, and advantages can be appreciated from the following description of certain embodiments and the accompanying drawing figures and claims.

DETAILED DESCRIPTION OF CERTAIN EMBODIMENTS OF THE DISCLOSURE

The present disclosure describes a system and method for deploying intelligent completions in open boreholes. The intelligent completions are cemented in place in order to ensure the full isolation of the gas cap, fractures and/or water bearing boundaries. Compartmentalization across open hole laterals is also achieved while enabling the actuation of downhole valves and gauges upon commands from the surface. The intelligent completion includes the deployment of feed through open hole packers and a cemented liner assembly. The cemented liner assembly is embedded as part of the intelligent completion and ensures the full isolation of the gas cap, fracture and/or water bearing boundaries which enhances production across all laterals in a multilateral extended reach well configuration. A diverse range of upper production assemblies can be used with the disclosed systems and methods, including electrically submersible pumps (ESP). The disclosed systems and methods can be customized to be deployed in single or multiple (e.g. two) trips to adapt to customer needs.

In the present disclosure, directional terms such as "above," "below," "upper," "lower," "upward," "downward," "uphole," "downhole" and the like are used in relation to the illustrative embodiments as they are depicted in the figures, in which the upward direction is toward the top of the corresponding figure and the downward direction is toward the bottom of the corresponding figure. It is to be understood that the uphole direction is toward the surface of the well and the downhole direction being toward the toc of the well.

Figure 1:
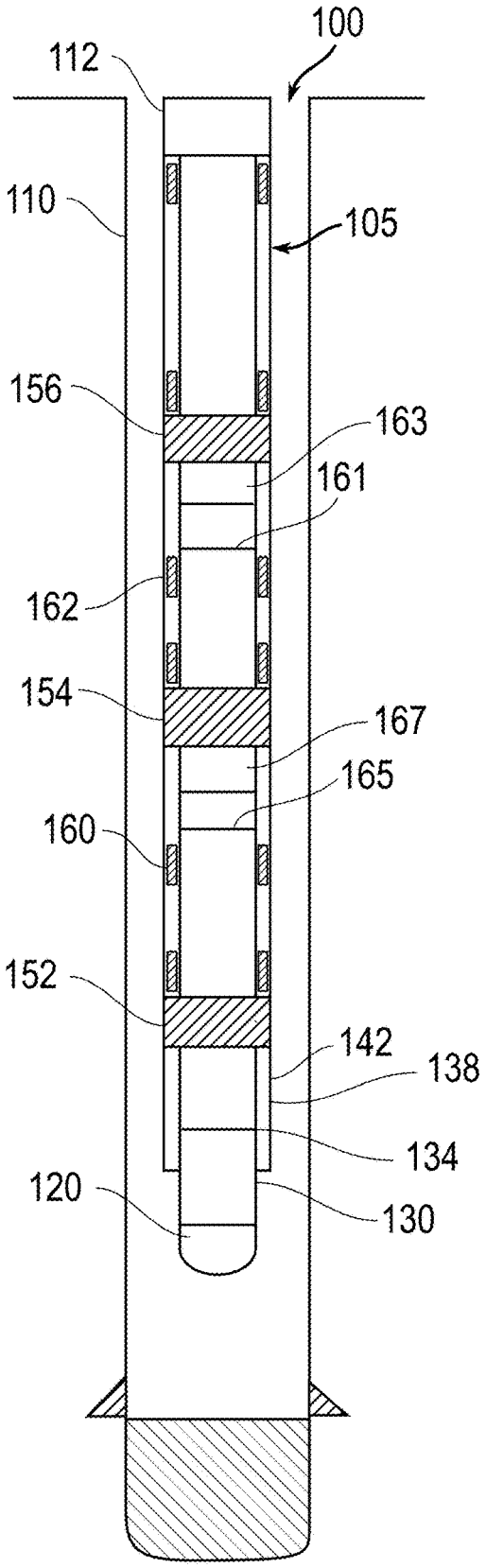
FIG. 1 is a schematic cross-sectional view of an embodiment of a lower section of a cemented open hole intelligent completion according to the present disclosure.

Referring now to FIG. 1, which is a schematic cross-sectional view of an embodiment of a lower section of a cemented open hole intelligent completion according to the present disclosure, the lower downhole section 105 of wellbore 100 extends through the various earth strata 110 in a geological formation. Disposed in the wellbore 100 is an intelligent completion assembly that extends through the wellbore from uphole to downhole. As shown starting at the downhole end of FIG. 1, the intelligent completion includes a shoe 120 which can comprise a bull plug, any kind of float shoe or a reciprocating or fluid activated-type reamer shoe assembly. Above the shoe 120, lower sections of intelligent completion components for each open hole lateral are deployed. Each section of the intelligent completion includes tubing 130, inflow control valve assemblies 134 with control lines 138, pressure and temperature gauges 142, feed through open hole swellable or mechanical packers e.g., 152, 154, 156 and offset centralizers 160, 162, where "offset" means positioned off of the centerline of the wellbore. Preferably, the centralizers are offset 180 degrees from each other and are positioned opposite to each other across the borehole. While in FIG. 1 tubing 130, the inflow control valve assemblies 134, control lines 138 and pressure and temperature gauges 142 are identified using a single reference number, it is to be understood that each of these components can be distributed at various locations throughout the downhole section shown. The electrical components, including the inflow control valve assemblies, control lines and gauges are collectively referred to as "intelligent components."

The shoe assembly 120 assists in passing across a tight or deteriorated open hole. The inflow control valve assemblies 134 can be opened or closed based by commands transmitted via control line 138 based on operational requirements. The commands can be issued from a surface-based controller (not shown in FIG. 1). The control lines 138 that extend downhole can be hydraulically and/or electrically activated and can be encapsulated for protection while the intelligent completion is being deployed in the open hole. The offset type centralizers 160, 162 prevent the sections deployed in the open hole from differentially sticking while being extended in the borehole and provide a suitable stand-off distance for cementing operations. Additionally, the centralizers 160, 162 facilitate deployment of the cables coupled to the inflow control valves 134 and pressure and temperature gauges 142 Additional pressure and temperature gauges are also deployed, for example a pressure and temperature gauge 163 positioned beneath packer 156, and another pressure and temperature gauge 167 positioned beneath packer 154. Each of the pressure and temperature gauges 163, 167 is positioned above and adjacent to respective inflow control valves with control lines 161, 165. The operations performed in downhole section 105 shown FIG. 1 is representative of a first stage of an intelligent completion process according to the present disclosure.

Figure 2:
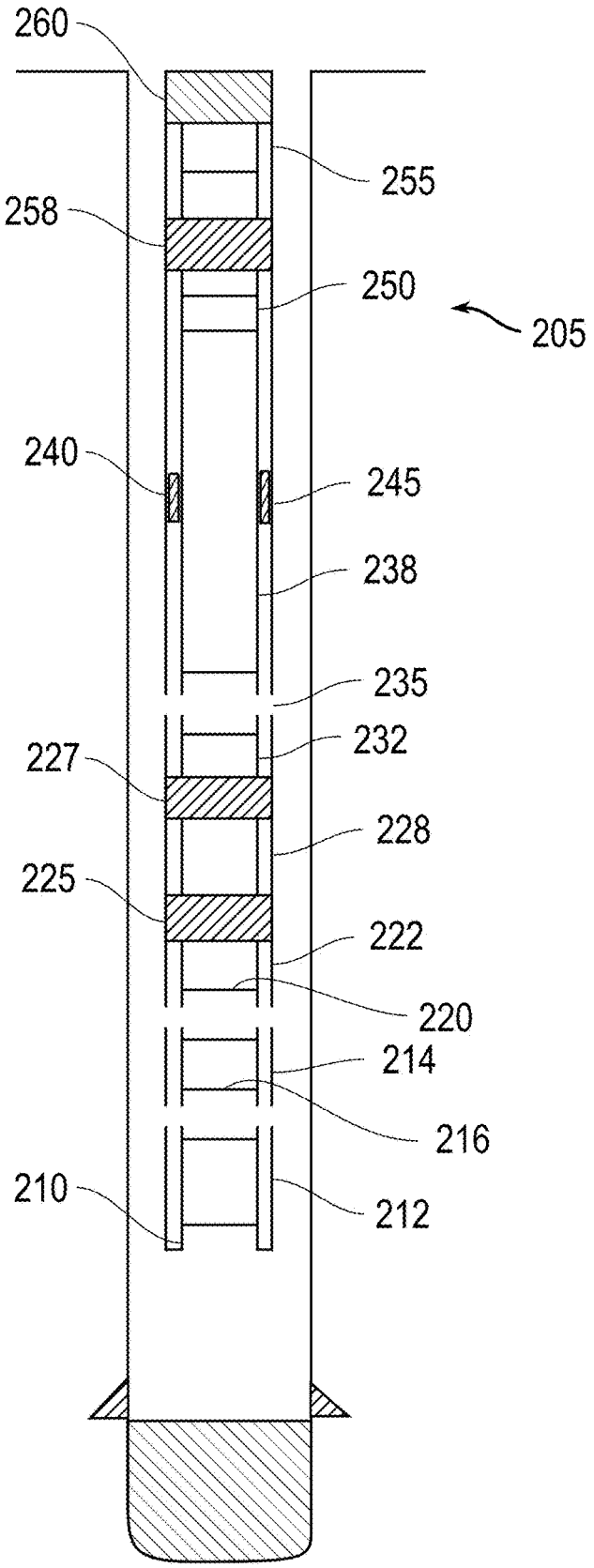
FIG. 2 is a schematic cross-sectional view of a next-higher section that is positioned directly above the section shown in FIG. 1 according to an embodiment of the present disclosure.

FIG. 2 illustrates a next-uphole section 205 that is positioned directly above the downhole section 105 shown in FIG. 1. This section includes an off-bottom cemented liner kit. Positioned at the bottom of section 205 is a ceramic disk assembly 210 that can aid in isolating the lower section 105 by intercepting cement debris which can be circulated out of the wellbore before reaching the lower section 105. However, it is noted that in some embodiments, the ceramic disk assembly can be omitted. At the bottom of section 205 is casing joint 212, which is a length of pipe that is threaded at both ends for connections to other sections of pipe. Above the casing joint is a pup joint 214 which is typically a length of pipe or tubing that is shorter than a casing joint. A float collar 216 can be positioned between the casing joint 212 and pup joint 214. Float collar 216 also typically consists of a short length of casing fitted with a check valve that can be used as a landing for cement plug during cementing operations. A ball seat collar 220 is positioned directly above pup joint 214, followed directly above by a further pup joint 222. In the depicted embodiment, above pup joint 222 are a pair of feed-through packers 225, 227 spaced apart by a pup joint 228. The following portion of section 205 in the uphole direction consists of a pup joint 232, a liner cementing valve 235 and a casing joint 238. Casing joint is sized to accommodate a selected amount of cement. Offset centralizers 240, 245 are positioned outside of casing joint 238. In some implementations a liner hanger assembly 250 can be situated atop casing joint 238. A liner setting sleeve 255 with a top thread connection is positioned at the top of section 205 above additional feed-through packer 258. The liner setting sleeve 255 is used to connect the running tool, which is used in the placement or setting of downhole equipment and the liner of the section 205. A wet connector assembly 260, also known as a "wet connector" or "wet-mate connector" is positioned at the top of section 205. The wet connector assembly 260 comprises a receptacle and a stinger and enables communication of electrical signals between the sensors and valve actuators in the lower completion sections with the surface and higher sections.

Conventional methods for cemented liners do not incorporate a liner setting sleeve as disclosed herein that includes an upper thread connection. In the method of the present disclosure, the liner setting sleeve 255 aids in connecting the wet connector receptacle 260 to the control lines that run through section 205 to section 105 below. In some implementations, a liner wiper plug can be connected to a running tool (not shown) and the running tool can be coupled to a liner hanger assembly which includes the liner hanger assembly 250, feed through packer 258 and the liner setting sleeve 255 with top connector. A further pup joint can be deployed to couple the feed-through packer 258 to the liner setting sleeve 255. The liner hanger assembly 250 is customized to including spaced setting slips arrangement with cable fit grooves that enable cable lines to pass and be secured beside the liner hanger slips without risk of damaging contact and during the liner hanger setting procedure. A standard hydraulic liner hanger can also be deployed but in this case precautions need to be taken while passing and securing the cables across the liner hanger slips area to avoid damage to the cable. In implementations in which a liner hanger is not deployed, a lower liner hanger (e.g., anchoring slips) can be run in section 105 above the bull plug 120 and can be set against the closed inflow control valves 134 prior to setting the feed through packers of section 205 to prepare for cementing. The offset centralizers are preferably installed with 180-degree phasing to provide free and secure passage of the control lines. During deployment of section 205, electrical connectivity and communication with downhole inflow control valves and pressure and temperature gauges is monitored and confirmed.

Figure 3:
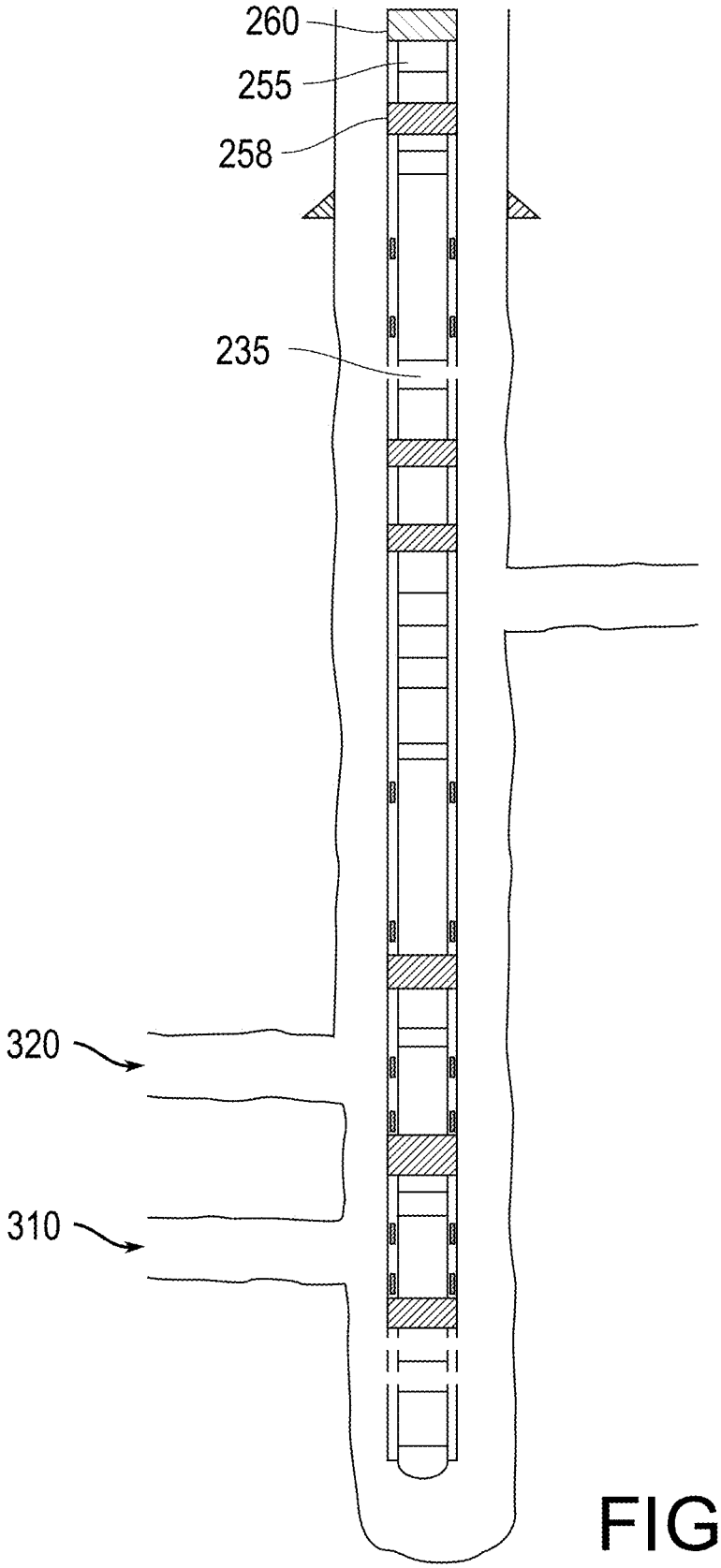
FIG. 3 is a cross-sectional view that depicts both of the sections shown in FIGS. 1 and 2 as connected according to an embodiment of the present disclosure.
Figure 4:
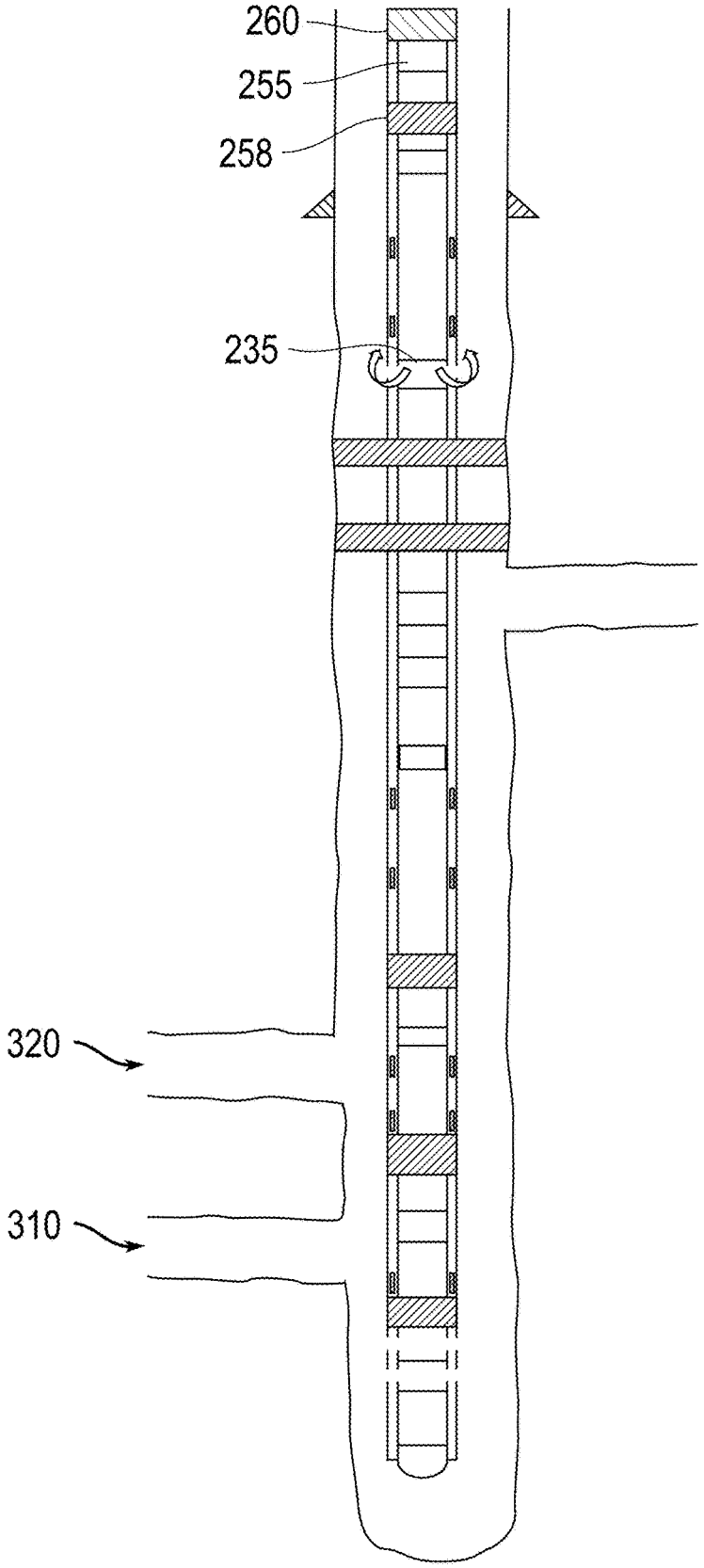
FIG. 4 is a cross-sectional view that depicts that sections shown in FIG. 3 after feed through packers have been set and the liner cementing valve has been opened to establish circulation according to an embodiment of the present disclosure.

Once downhole section 205 of the completion string has been set on the casing slips, the wet connector receptacle 260, which can be equipped with a cable protective sleeve, is fully connected on top of the liner setting sleeve 255. This shown in FIG. 3 which depicts both sections 105 and 205 after being connected. Both sections 105 and 205 are run on drill string to the required setting depth across open hole laterals 310, 320 while filling the well with completion fluid, via tubing. After deployment of the strings at depth, a ball (not shown) is dropped and pumped down to the ball collar 220. If a liner hanger is deployed, pressure is applied from surface by rig pumps or any pumping unit to set the liner hanger. Upon confirmation that liner hanger 250 is set, further pressure is applied to set the two feed through packers 225, 227 in section 205 above the ball seat and below the liner cementing valve 235. Once this process is completed, higher pressure from surface pumps or by any pumping unit is applied to open the liner cementing valve. This stage of the process is shown in FIG. 4. The opening of the liner cementing valve 235 is indicated by a pressure drop and circulation of completion fluid. Connectivity and communication with downhole control valves and temperature gauges is continually monitored throughout the stages of the processes shown in FIGS. 3 and 4.

Figure 5:
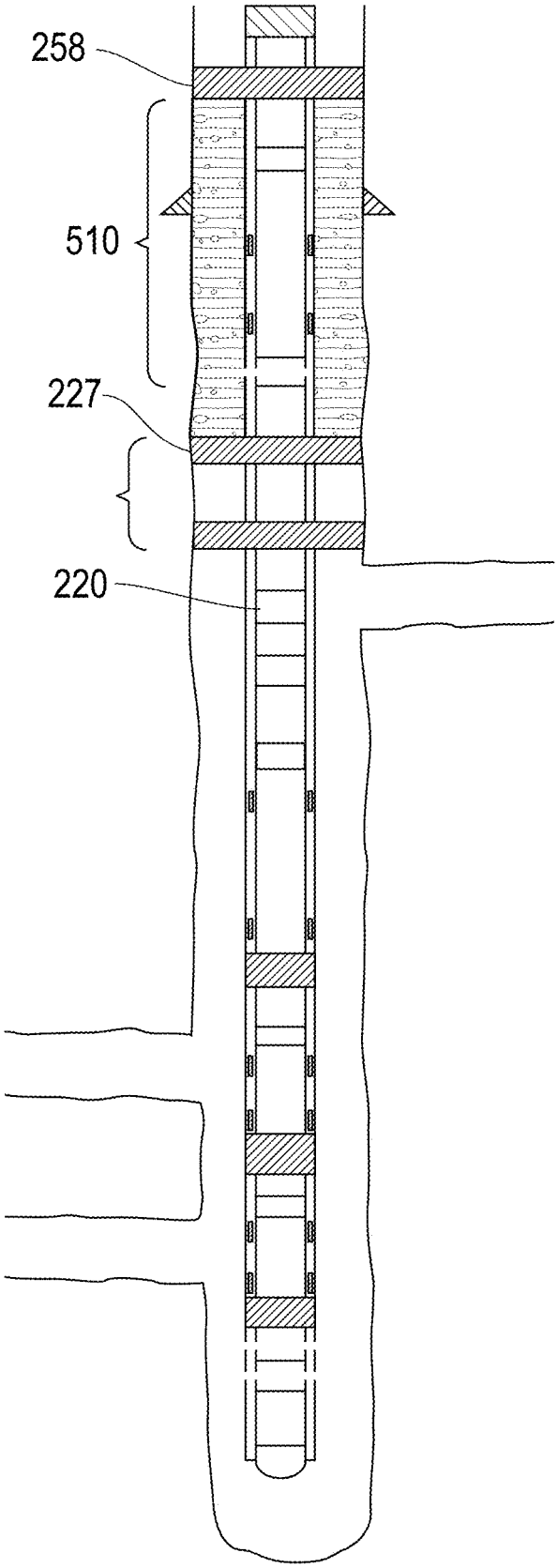
FIG. 5 is another cross-sectional view showing the state of the intelligent completion process after cement has been delivered downhole according to an embodiment of the present disclosure.

FIG. 5 is a cross-sectional view showing the state of the intelligent completion process after cement has been delivered downhole according to an embodiment of the present disclosure, resulting in cemented section 510. After completion of the previous stage, circulation is achieved through the liner cementing valve. In the next step, a required volume of cement is mixed. The volume is set to accommodate enough cement behind the liner up to the feed through packer 258. The required volume of spacer is pumped downhole, followed by cement slurry. The pump down plug (not shown in FIG. 5) is dropped and displaced using a spacer with completion fluid until the fluid reaches a liner wiper plug (also not shown in FIG. 5) located in the running tool. The cement slurry is displaced while the liner wiper plug and pump down plug are pumped downhole until the plugs reach the ball seat collar 220 without exceeding the theoretical volume of displacement fluid. After these steps are completed, the liner cementing valve 235 is closed with required pressure and checked for back flow. The section cemented during this procedure 510 runs from packer 227 uphole to packer 258. Packer 227 thereby forms the seat of the cemented section 510 and therefore can be referred to as the setting packer. Pressure is applied to set feed through packer 258. Thereafter, the running tool assembly is picked up above the wet connector bbb. Reverse circulation is established at a high pumping rate in order to keep the wet connector receptacle free of any excess cement. Once reverse circulation is performed and any cement in excess is circulated out of the hole, normal circulation is then performed with inhibited completion fluid and the running tool is pulled out of the hole.

A clean out assembly (not shown) is then deployed in section 205. The clean out assembly can include through tubing under reamer assembly dressed with Tungsten Carbide inserts or a similar drilling tool. Care is taken while passing through the wet connector receptacle 260. Once cement or cement stringers are tagged the reamer assembly is activated to drill out the cement and floats. The pressure of the cemented open hole intelligent completion against ball seat collar 220 is tested to check the integrity of the section 205. In addition, the ball seat collar is 220 drilled out to a position above the ceramic disk assembly 210 (if installed). Sweep pills can be used to clean the hole with circulation of non-damaging inhibited completion fluid. Further pressure tests can be carried out. The reamer assembly is then deactivated and removed from the borehole. An additional cleaning operation can be performed using a Venturi tubing tool collect any debris left on the ceramic disk 210. This additional step ensures that that any debris that remains as a result of the drill-out operations is recovered to avoid having any undesirable debris fall into section 105 of the intelligent completion during later procedures.

Figure 6:
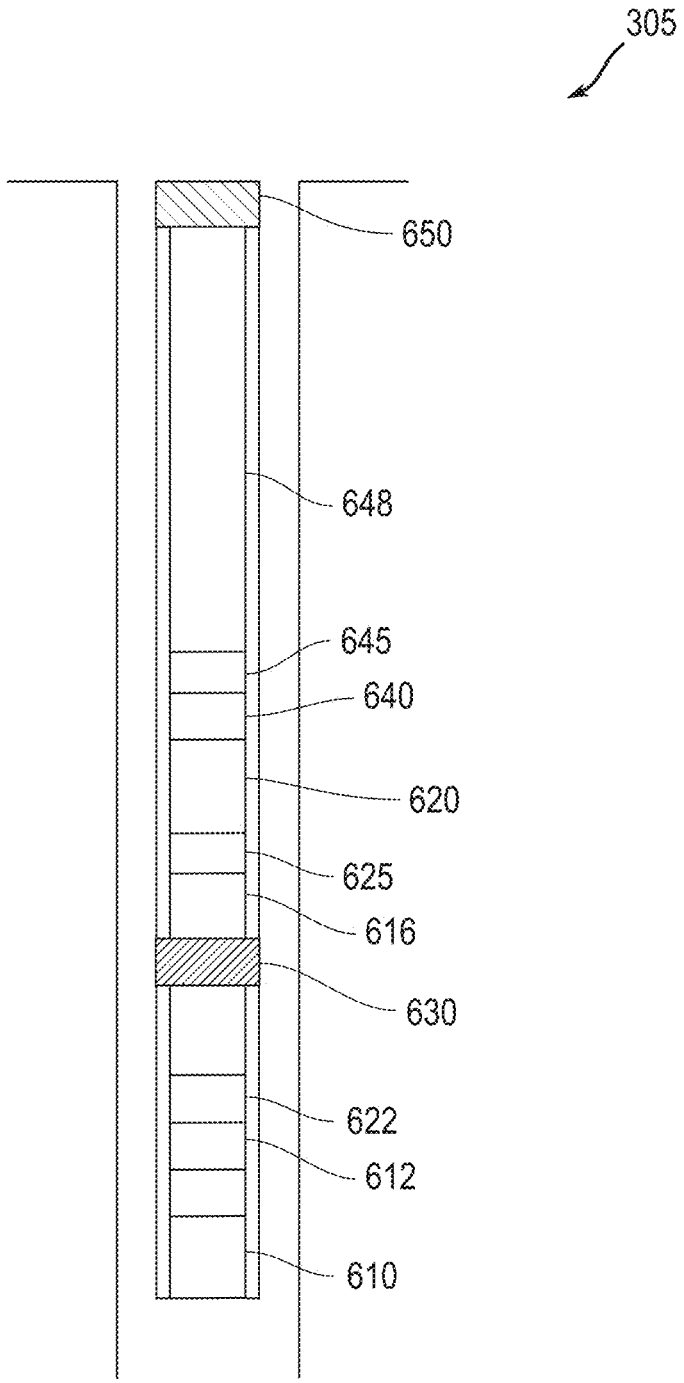
FIG. 6 is a cross-sectional view that depicts that an additional section of the intelligent completion string before being positioned on top of the sections shown in FIGS. 1-5 according to an embodiment of the present disclosure.

FIG. 6 is a cross-sectional view of an additional completion string section 305, which is the upper section of the intelligent completion. Section 305 comprises a wet connector stinger assembly 610. The stinger assembly 610 is a prong that hooks into the wet connector receptacle 260 in section 205. The section further includes tubing joints and pup joints, e.g., 612, 616, 620, and tubing nipples, e.g., 622, 625 which are short lengths of tubing with special internal profiles to allow setting plugs. A feed through cased hole production packer 630 (optional) is positioned between tubing joints 612, 616. Pressure and Temperature gauges of either dual or single type with control lines 640 are positioned above production packer 630. An optional sliding sleeve 645 is positioned above (uphole) of the pressure and temperature gauges 640. The remainder of section 305 comprises additional tubing and pup joints 648 and a tubing hanger 650. In this section, a range of different upper production assemblies can be used, ESPs for example, to mention one.

Figure 7:
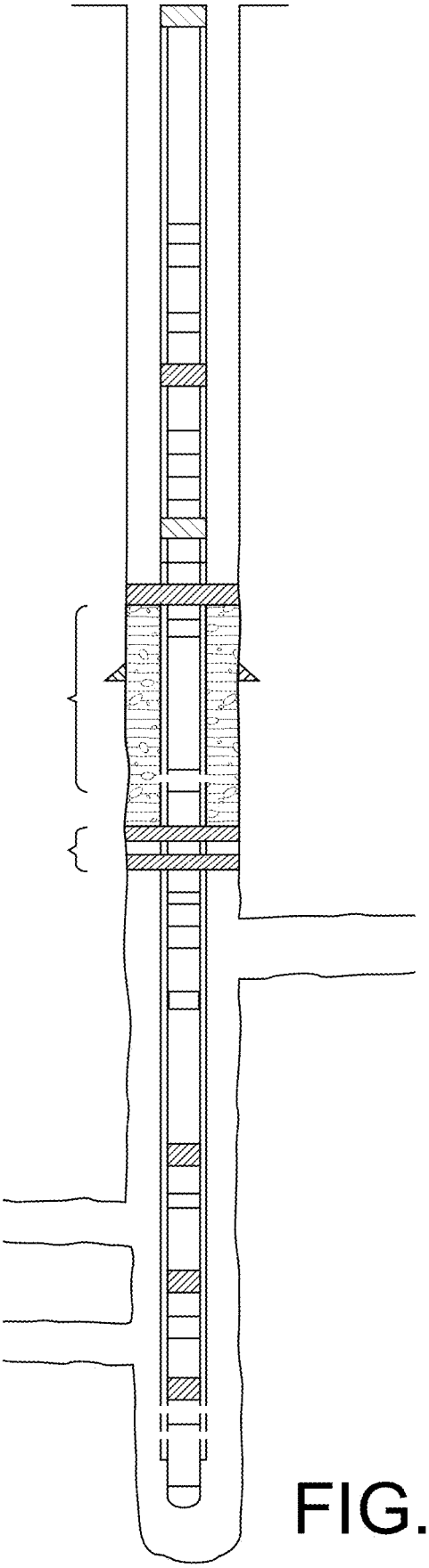
FIG. 7 is a cross-sectional view depicting the three completion string sections assembled together after deployment according to an embodiment of the present disclosure.

Referring now to FIG. 7, section 305 is connected to section 205 and filled with completion fluid during deployment. The wet connector stinger assembly 610 is latched into the receptacle of the wet connector assembly 260. Connectivity and communication between a surface control panel and the inflow control valves and sensor gauges is verified. The magnitude of spacing required for suitable landing of the tubing hanger is then determined. In some implementations, a pre-space out determination can also be performed before the stinger assembly 610 is latched to the receptacle of the wet connector assembly 205. After the spacing determination has been made, the receptacle of the wet connector assembly is unlatched. Tubing is displaced with required inhibited completion fluid and the stinger assembly 610 is latched again to the receptacle of the wet connector assembly 260. At this point, the tubing hanger is landed. The tubing and TCA are tested to ensure full tubing and casing integrity.

Figure 8:
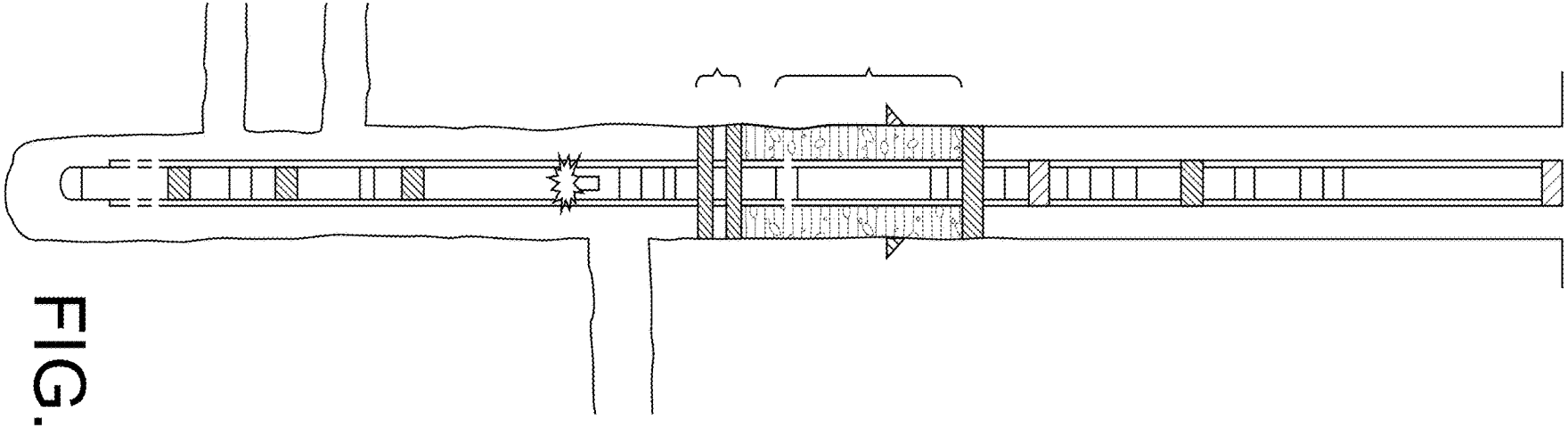
FIG. 8 is a cross-sectional view that illustrates the breaking of the ceramic disk deployed in the completion string according to an embodiment of the present disclosure.
Figure 9:
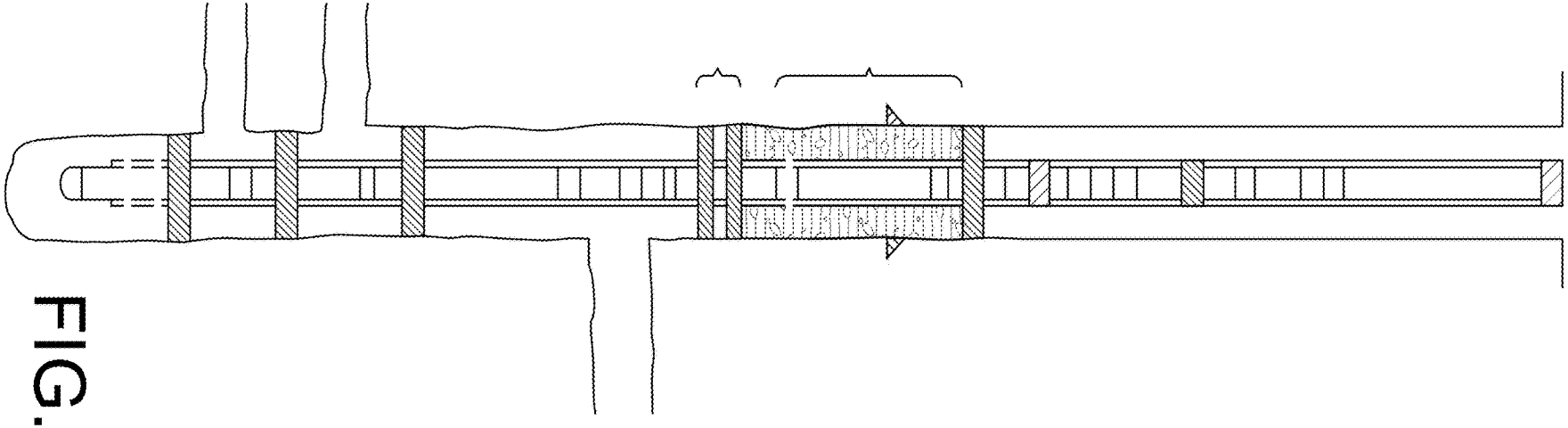
FIG. 9 is a cross-sectional view that illustrates a subsequent stage of the intelligent completion process in which packers located in a bottom section of the string are set across open hole laterals.

A sinker bar is run in the hole. The ceramic disk (if installed) 210 (shown in FIG. 2) is broken with the sinker bar then the sinker bar continues running in the hole to a maximum reached depth to ensure that the cemented intelligent completion is free of debris. This stage is shown in FIG. 8. However, in some implementations this step can be delayed and performed at a later stage after installation of the production tree. Connectivity and communication with downhole tubing inflow control valves and pressure and temperature gauges is checked and all of the inflow control valves are closed and the feed through production packers 152, 154, 156 are set across open hole laterals 310, 320 are closed. This stage is shown in FIG. 9. Following these steps, tubing plugs are installed and tested for further operation as mechanical barriers. Any sliding sleeve incorporated in the upper section 305 is opened to displace tubing and TCA with required inhibited completion fluid. Upon completion of this task the sliding sleeve is closed and casing integrity is retested again. Several further steps are performed to prepare the well for production including retrieval of the tubing plugs. At this point the intelligent completion process according to the present disclosure is finalized.

The system and methods of the present disclosure combines the tasks of running intelligent completions strings and installation of off-bottom cemented liners. These measures enable intelligent completion technology in open hole applications for which zonal isolation with cement is required.

It is to be understood that any structural and functional details disclosed herein are not to be interpreted as limiting the systems and methods, but rather are provided as a representative embodiment and/or arrangement for teaching one skilled in the art one or more ways to implement the methods.

It is to be further understood that like numerals in the drawings represent like elements through the several figures, and that not all components or steps described and illustrated with reference to the figures are required for all embodiments or arrangements.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and "comprising", when used in this specification, specify the presence of stated features, integers, steps, operations, elements, or components, but do not preclude the presence or addition of one or more other features, integers, steps, operations, elements, components, or groups thereof.

Terms of orientation are used herein merely for purposes of convention and referencing and are not to be construed as limiting. However, it is recognized these terms could be used with reference to a viewer. Accordingly, no limitations are implied or to be inferred.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The subject matter described above is provided by way of illustration only and should not be construed as limiting. Various modifications and changes can be made to the subject matter described herein without following the example embodiments and applications illustrated and described, and without departing from the true spirit and scope of the invention encompassed by the present disclosure, which is defined by the set of recitations in the following claims and by structures and functions or steps which are equivalent to these recitations.

What is claimed is:

1. A method of providing a cemented open hole intelligent completion in a well containing an open hole having a perimeter in which one or more laterals are embedded, the method comprising:

deploying a first string section in a portion of the open hole containing the one or more laterals, the first section having intelligent completion components including inflow control valves, temperature and pressure gauges and control lines that communicate with and are operable from a surface station;

deploying a second string section coupled to and positioned above the first string section and above all of the one or more laterals, the second string section including a liner and a liner hanger assembly controllable to fix the liner with respect to the open hole, the second string section further including a disk assembly, a casing joint, a pup joint, a liner cementing valve and a setting packer expanded up to the perimeter of the open hole; and delivering cement downhole, the cement setting in a cemented section comprising an annulus between the second string and the perimeter of the open hole, the cemented section being seated on the setting packer, wherein the cemented section is positioned above all of the one or more laterals so as to block fluids that emanate from the one or more laterals from production while not interfering with communication between the surface and the intelligent components of the first string.

2. The method of claim 1, further comprising deploying centralizers inside the cemented section that are offset between 140 and 180 degrees from each other in a horizontal plane that are adapted to prevent sections deployed in the open hole from differentially sticking while running in the hole.

3. The method of claim 1, further comprising deploying a ceramic disk at a bottom of the second string to assist in isolating the first string section of the intelligent completion components.

4. The method of claim 1, further comprising deploying a liner setting sleeve having a top thread connection and a wet connector assembly having a receptacle at a top of the second string section to ensure electrical connection between the surface and the first string components.

5. The method of claim 4, wherein the liner setting sleeve is part of an assembly including the liner hanger assembly and a feed through packer.

6. The method of claim 1, further comprising deploying a liner cementing valve above the setting packer, wherein the liner cementing valve is opened to allow cement to be delivered downhole and to be positioned in the cemented section.

7. The method of claim 1, wherein the disk assembly is made of glass or ceramic.

8. The method of claim 1, wherein the second string further includes a ball seat collar.

9. The method of claim 8, wherein the second string further includes a float collar.

10. A cemented open hole intelligent completion system for a well containing an open hole having a perimeter in which one or more laterals are embedded, the system comprising:

a first string section positioned in a portion of the open hole containing the one or more laterals, the first string having intelligent completion components including inflow control valves, temperature pressure gauges and control lines that communicate with and are operable from a surface station;

a second string section coupled to and positioned above the first string section and above all of the one or more laterals, the second string section including a liner hanger assembly, a disk assembly, a casing joint, a pup joint, a liner cementing valve and a setting packer expanded up to the perimeter of the open hole; and a cemented section seated on the setting packing comprising an annulus between the second string and the perimeter of the open hole, wherein the cemented section is positioned above all of the one or more laterals so as to block fluids that emanate from the one or more laterals from production while not interfering with communication between the surface and the intelligent components of the first string.

11. The cemented open hole intelligent completion system of claim 10, further comprising centralizers inside the cemented section that are offset between 140 and 180 degrees from each other in a horizontal plane that are adapted to prevent, sections deployed in the open hole from differentially sticking while running in the hole.

12. The cemented open hole intelligent completion system of claim 10, further comprising a ceramic disk positioned at a bottom of the second string to assist in isolating the first string section of the intelligent completion components.

13. The cemented open hole intelligent completion system of claim 7, further comprising a liner setting sleeve having a top thread connection and a wet connector assembly having a receptacle positioned at a top of the second string section to ensure electrical connection between the surface and the first string components.

14. The cemented open hole intelligent completion system of claim 10, further comprising a liner cementing valve positioned above the setting packer, wherein the liner cementing valve is opened to allow cement to be delivered downhole and to be positioned in the cemented section.

15. The cemented hole open hole intelligent completion system of claim 10, wherein the disk assembly is made of glass or ceramic.

16. The cemented hole open hole intelligent completion system of claim 10, wherein the second string further includes a ball seat collar.

17. The cemented hole open hole intelligent completion system of claim 16, wherein the second string further includes a float collar.

* * * * *